United States Patent [19]

Hill

[11] 4,097,195

[45] Jun. 27, 1978

[54] HIGH VACUUM PUMP

[75] Inventor: Eugene F. Hill, Belmont, Calif.

[73] Assignee: Varian Associates, Inc., Palo Alto, Calif.

[21] Appl. No.: 621,329

[22] Filed: Oct. 10, 1975

Related U.S. Application Data

[63] Continuation of Ser. No. 549,217, Feb. 12, 1975, abandoned, which is a continuation of Ser. No. 367,025, Jun. 4, 1973, abandoned.

[51] Int. Cl.[2] ..... F04B 37/02; H01J 19/70

[52] U.S. Cl. ..... 417/49; 313/174

[58] Field of Search ..... 417/49; 313/174 T; 75/175.5; 74/174, 175.5, 176; 252/181.1, 181.6

[56] References Cited

U.S. PATENT DOCUMENTS

| | | | |
|---|---|---|---|
| 3,147,910 | 9/1964 | Jepsen | 417/49 |
| 3,460,745 | 8/1969 | Lamont | 417/49 |
| 3,574,569 | 4/1971 | Vordahl | 75/175.5 |
| 3,767,480 | 10/1973 | Schuler et al. | 75/175.5 |

*Primary Examiner*—William L. Freeh
*Attorney, Agent, or Firm*—Stanley Z. Cole; Leon F. Herbert; John J. Morrissey

[57] ABSTRACT

The pressure range, pumping speed and through-put of a high-vacuum pump can be significantly improved, particularly with respect to the pumping of hydrogen, by making pump components that are exposed to the vacuum from an alloy that is metallurgically stabilized to maintain a body-centered cubic crystal lattice structure throughout the range of temperatures usually experienced by the pump. In a sputter-ion pump, the cathode especially should be made from an alloy stabilized in the body-centered cubic crystal lattice form. A suitable alloy, which is so stabilized in the body-centered cubic crystal lattice form, has a major constituent comprising one or more elements selected from Group IV B of the conventional long form of the Periodic Chart of the Elements, and a minor constituent comprising one or more elements selected from Groups III B, V B, VI B and VII B of the Chart, with the minor constituent constituting at least 10% but not more than 50% by weight of the alloy. The alloy may have an additional constituent comprising one or more elements selected from Group III A or from any other Group of the Chart, provided that this additional constituent does not constitute more than 5% by weight of the alloy. Particular commercially available alloys that are suitable according to this invention include Ti-13V-11Cr-3Al and Ti-11.5Mo-6Zr-4.5Sn.

12 Claims, 1 Drawing Figure

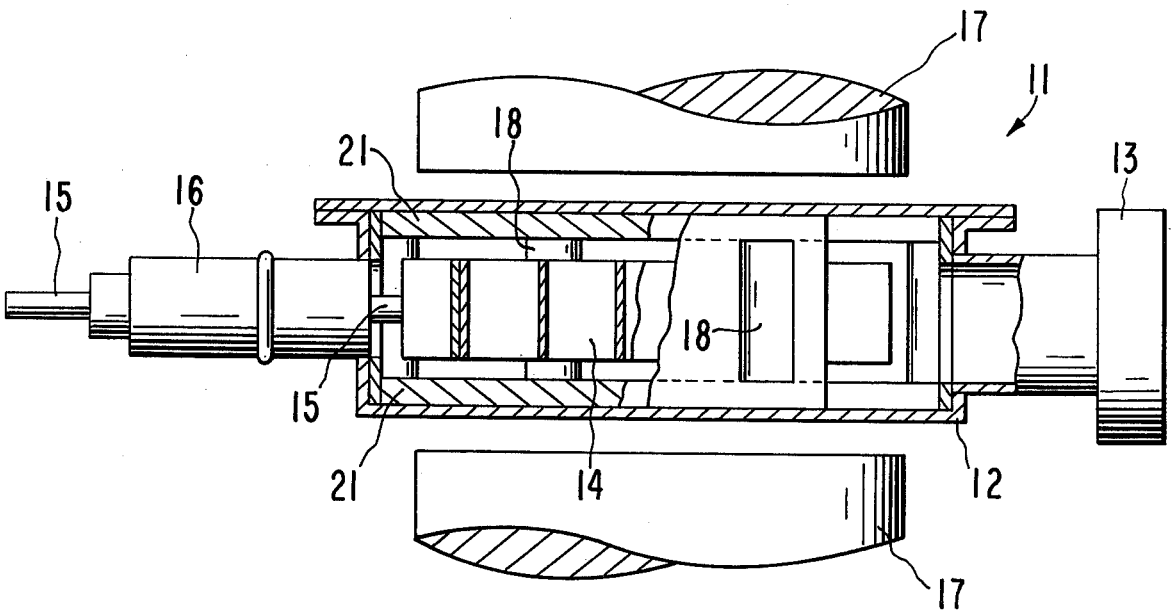
17
11
18
21
13
15
16
18
15
21
14
12
17

HIGH VACUUM PUMP

This is a continuation of application Ser. No. 549,217 filed Feb. 12, 1975 now abandoned which is a continuation of Ser. No. 367,025 filed June 4, 1973 now abandoned.

BACKGROUND OF THE INVENTION

1. Field of the Invention

This invention is a further development in high-vacuum technology, particularly with respect to the pumping of hydrogen.

2. Description of the Prior Art

The primary mechanism for the pumping of hydrogen by a sputterion pump is by burial of the hydrogen in the pump cathode, as was discussed by J. H. Singleton in an article in the January/February 1971 issue of The Journal of Vacuum Science and Technology, Vol. 8, No. 1, at pages 275–282. In order to pump hydrogen effectively, a sputter-ion pump cathode must have a high hydrogen sorption capacity and must also have a high rate of diffusion of hydrogen. Metals which have a high heat of reaction with hydrogen, i.e., which readily form hydrides, provide the necessary high solubility for hydrogen gas. However, such hydride forming metals tend to develop hydride surface barriers to the transfer of hydrogen from the gaseous phase into the bulk of the cathode. Singleton concluded that this hydride surface barrier effect is probably the cause of the low pumping speed for hydrogen that was exhibited by sputter-ion pumps operating at pressures below $10^{-9}$ Torr. Singleton's solution to the problem of overcoming the hydride surface barrier to hydrogen diffusion was to suggest that a supplementary sublimation or getter pump be used in conjunction with a sputter-ion pump to achieve pressures below $10^{-9}$ Torr.

Earlier investigators had disclosed techniques for increasing the effective surface area available on a sputter-ion pump cathode for the diffusion of hydrogen gas into the bulk of the cathode metal. For example, U.S. Pat. No. 3,147,910, issued Sept. 8, 1964 to R. L. Jepsen and assigned to Varian Associates, disclosed a technique for forming the cathode from powdered metal or from a metal that has been fractured by mechanical deformation. Such techniques, however, did not address the problem of overcoming the hydride surface barrier to hydrogen diffusion.

It has been known for some time that certain alloys can sorb certain gases more readily than can other alloys for particular temperature ranges. For example, U.S. Pat. No. 2,926,981, issued Mar. 1, 1960 to V. L. Stout, et al., disclosed that certain zirconium-titanium alloys can sorb oxygen, water vapor and air more readily than can other getter materials in the 375° C temperature region. Stout, et al. attributed the superior sorption capability of the indicated zirconium-titanium alloys at such high temperatures to the breakdown at such high temperatures of an oxide surface barrier which is present of these same alloys at lower temperatures and which inhibits the diffusion of gases, including hydrogen, into the bulk of the cathode.

An article by L. D. Hall in the January/February 1969 issue of *The Journal of Vacuum Science and Technology,* Vol. 6, No. 1, at pages 44–47, provides a general discussion of techniques for improving the operation of sputter-ion pumps. Hall investigated a number of singlecomponent and multicomponent getter materials, where each singlecomponent material comprised a strip of a particular metal and each multicomponent material comprised a combination of alternately disposed strips of different metals. These investigations indicated the superior capability of certain combinations of zirconium strips and titanium strips for pumping residual gases, including hydrogen, from vacuum enclosures. Hall suggested that this superior capability might be due to an alloying effect of one metal upon the other, but no results were reported of experiments with actual alloys of zirconium and titanium.

U.S. Pat. No. 3,684,401, issued Aug. 15, 1972 to J. H. Singleton, which was filed on Nov. 17, 1970, disclosed that where an ion pump cathode is made from one or more metals chosen from the group consisting of zirconium, thorium, titanium, tantalum, niobium and vanadium alloyed with one or more metals chosen from the group consisting of aluminum, silicon and beryllium, a constant rate of diffusion of hydrogen into the cathode can be maintained down to lower pressures than had been obtainable using other cathode materials. According to Singleton, the alloying effect of the metals from which the cathode is formed serves to inhibit the formation of nitride surface barriers to the diffusion of hydrogen into the bulk of the cathode. The effect of the crystal structure of the alloy on the rate of diffusion of hydrogen, however, was not discussed. In the aforementioned 1971 article in *The Journal of Vacuum Science and Technology,* Singleton indicated that with respect to a single-element cathode, namely, titanium, the expansion of the crystal lattice in the vicinity of the cathode surface due to hydride formation appears to enhance hydrogen pumping speed. However, this enhanced pumping speed was attributed to an increased in effective surface area of the cathode caused by the strain which the hydride formation causes to the crystal lattice near the surface. It is significant that the alloying elements disclosed in the Singleton patent, namely, aluminum, silicon and beryllium, have the metallurgical effect of stabilizing the crystal lattice of the alloy in the hexagonal close-packed form at temperatures up to 1100° C.

The prior art did not recognize the relationship between the pumping capability of a vacuum pump component and the crystal structure of the material out of which the pump component is made. Sputter-ion pump cathodes, for example, are typically made from metals that exhibit the hexagonal close-packed crystal lattice structure at room temperatures and undergo a transformation to the body-centered cubic crystal lattice structure at some transition temperature in the 850° to 900° C range depending upon the particular material. Metallurgical alloying techniques are known for lowering the transition temperature for the transformation of a particular material from one crystal lattice form to the other, i.e., for stabilizing the particular material in the body-centered cubic crystal lattice form down to lower temperatures than would be possible for that same material in an unalloyed state. However, the prior art did not recognize that by metallurgically stabilizing the crystal lattice of a vacuum pump component so that it would remain in the body-centered cubic form throughout the range of temperatures usually experienced by the pump, i.e., from pumping temperatures down to ambient non-operating temperatures, the rate of diffusion of hydrogen into the pump component could be significantly increased and the pumping capability of the component with respect to hydrogen could thereby be greatly improved.

SUMMARY OF THE INVENTION

This invention recognizes that optimum pumping of hydrogen gas by a vacuum pump can be achieved by making the components of the pump that are exposed to the vacuum region, particularly the cathode in the case of a sputter-ion pump, out of a metal that has a high solubility for hydrogen gas, a high heat of reaction for the formation of hydride compounds, and a high rate of diffusion for hydrogen gas throughout the entire temperature range that the pumping system will normally experience, i.e., from ambient nonoperating temperatures in the 20° C region up through pumping and pump bakeout temperatures.

In particular, this invention recognizes that where a vacuum pump component is formed from an alloy which has a major constituent selected from one or more of the elements in Group IV B of the conventional long form of the Periodic Chart of the Elements, with a minor constituent being added to stabilize the crystal lattice structure of the alloy in the body-centered cubic form over the temperature range to which the pump will be exposed both when operating and when not operating, the pump component will have a significantly higher rate of hydrogen diffusion into its bulk than will a pump component made from an unalloyed Group IV B major constituent in the hexagonal close-packed form that usually obtains at room temperature.

This invention further recognizes that zirconium and titanium, which are known to be good sputter-ion pump cathode materials because of their high gas sorption capacities, can be metallurgically stabilized to maintain body-centered cubic crystal lattice structures throughout the temperature range from room temperature to sputtering temperatures by being alloyed with one or more elements selected from the group comprising vanadium, niobium, tantalum, chromium, molybdenum, tungsten, manganese, scandium, yttrium, and the elements of the lanthanum series. It is believed that the elements of the actinium series would also be effective in a metallurgical sense for stabilizing zirconium and titanium alloys in the body-centered cubic crystal lattice form, but because of the radioactivity of the actinium series elements it appears unlikely at this time that such elements would be used as alloying agents.

It is therefore an object of this invention to provide a sputter-ion pump having a cathode made from an alloy having a major constituent comprising one or more elements selected from Group IV B of the conventional long form of the Periodic Chart of the Elements and a minor constituent that metallurgically stabilizes the alloy to maintain a bodycentered cubic crystal lattice structure throughout the temperature range ordinarily experienced by the pump.

It is a further object of this invention to provide a sputter-ion pump wherein a component that is exposed to the vacuum is made from an alloy having a major constituent comprising one or more elements selected from Group IV B of the conventional long form of the Periodic Chart of the Elements and a minor constituent that metallurgically stabilizes the alloy to maintain a body-centered cubic crystal lattice structure throughout the temperature range ordinarily experienced by the pump.

It is also an object of this invention to provide a cathode for use in a sputter-ion pump, which cathode is made from an alloy having a major constituent comprising one or more elements selected from Group IV B of the conventional long form of the Periodic Chart of the Elements and a minor constituent that metallurgically stabilizes the alloy to maintain a body-centered cubic crystal lattice structure throughout the temperature range ordinarily experienced by the pump.

It is likewise an object of this invention to provide a diode sputter-ion pump wherein the anode is an integral part of the vacuum envelope, and wherein the cathode and the vacuum envelope are made from an alloy having a major constituent comprising one or more elements selected from Group IV B of the conventional long form of the Periodic Chart of the Elements and a minor constituent that metallurgically stabilizes the alloy to maintain a body-centered cubic crystal lattice structure throughout the temperature range ordinarily experienced by the pump.

The alloy that will accomplish the above-stated objects consists essentially of a major constituent comprising one or more elements selected from Group IV B of the conventional long form of the Periodic Chart of the Elements and a minor constituent comprising one or more elements selected from Groups III B (including the lanthanum series), V B, VI B and VII B of the conventional long form of the Periodic Chart of the Elements, with the minor constituent constituting at least 10% but not more than 50% by weight of the alloy. The alloy may, but need not necessarily, have an additional constituent comprising one or more elements selected from Group III A or from any other Group of the Periodic Chart, provided that this additional constituent does not constitute more than 5% by weight of the alloy.

BRIEF DESCRIPTION OF THE DRAWING

The drawing shows a front view, partly in cross section, of a sputter-ion pump embodying the present invention.

DETAILED DESCRIPTION OF THE INVENTION

The drawing shows a particular sputter-ion pump 11 having a hollow envelope 12, with one open end thereof attached to a mounting flange 13. A cellular open-ended anode electrode 14 is carried within the envelope 12 upon the end of a conductive rod 15 which extends outwardly of the envelope 12 through an aperture therein. The conductive rod 15 is insulated from and carried by the envelope 12 through the intermediary of annular insulator assembly 16. The free end of the conductive rod 15 provides a terminal for applying a positive anode voltage to the anode electrode 14. Straddling the envelope 12 is a pair of pole pieces 17 of a magnet which provides a magnetic field through the open ends of the anode 14. Mounted on the inner walls of the vacuum envelope 12 and opposite the open ends of cellular anode electrode 14 are two cathode plates 21 spaced apart by the spacing bands 18. The cathode plates 21 are made of an alloy comprising one or more elements chosen from Group IV B of the conventional long form of the Periodic Chart of the Elements, preferably an alloy of zirconium or titanium, that is metallurgically stabilized to maintain a body-centered cubic crystal lattice structure throughout the temperature range that the pump will ordinarily experience, as will be discussed in more detail hereinafter.

In typical operation, the flange member 13 is connected for gas communication to a suitable vacuum system mating flange (not shown), and a positive potential is applied to the anode 14 via conductive rod 15 while the envelope 12 and supported cathode electrodes 21 are preferably operated at ground potential.

Ionization which results from the combined effect of the potential difference between the cathode and anode electrodes and the applied magnetic field is well known in the sputter-ion pump art and will be described only briefly.

In steady state operation, electrons emitted from the cathode electrodes 21 as well as free electrons are attracted to the anode electrode 14 because of the positive potential thereon, but are constrained by the magnetic field from directly reaching the anode electrode 14. At least some of these electrons collide with gas molecules to form positive gas ions and other electrons that are added to the discharge. The positive ions are driven into the cathode electrodes 21, dislodging particles of cathode material which are thereby sputtered onto the surrounding structure to produce gettering of gas molecules that come into contact therewith. In this manner, the envelope 12 and therefore structures communicating therewith are evacuated. For a further discussion of the operation of this pump, reference is made to U.S. Pat. No. 3,088,657 issued Mar. 23, 1959 to Zaphiropoules, et al. and assigned to Varian Associates.

Residual amounts of hydrogen gas remaining in the envelope 12 at pressures below $10^{-8}$ Torr have been extremely difficult to pump. In the first place, hydrogen has a low ionization probability so that fewer ions are produced for a given electron density in the pump. Furthermore, the light hydrogen molecules are not capable of sputtering large amounts of cathode material. Consequently, the principal mechanism for the pumping of hydrogen gas must be by diffusion of the hydrogen into the cathode or other components exposed to the vacuum.

According to this invention, it has been found that the rate of diffusion of a gas into an ion-pump cathode is a function of the crystal lattice structure of the cathode. In particular, with respect to zirconium and titanium, the rate of diffusion of hydrogen is greater for the body-centered cubic crystal lattice structure than for the hexagonal close-packed crystal lattice structure. At room temperature, both pure zirconium and pure titanium exhibit the hexagonal close-packed crystal form. However, the crystal structure of pure zirconium converts to the body-centered cubic crystal form at about 862° C, and the crystal structure of pure titanium converts to the body-centered cubic crystal form at about 900° C. The operating temperature range of a zirconium or titanium sputter-ion pump cathode during usual pumping operation is well below 862° C, typically being in the range from about 50° to about 300° C. Thus, to achieve optimum pumping capability with respect to hydrogen gas, it is necessary to alloy the zirconium or the titanium with a suitable element or elements in the proper proportions that will stabilize the resulting alloy in the body-centered cubic crystal lattice form, at least at pumping temperatures but preferably at all temperatures in the temperature range that the sputter-ion pump will experience (i.e., from ambient non operating temperatures in the 20° C region up through pumping and pump bakeout temperatures). Another way of stating this requirement is that the zirconium or titanium cathode material must be alloyed with a suitable element or elements in the proper proportions to cause a significant lowering of the transition temperature at which the crystal lattice of the resulting alloy is transformed from the hexagonal closed-packed form to the body-centered cubic form. It is also necessary to minimize the amount of alloying material that would tend to stabilize the zirconium or titanium in the hexagonal close-packed crystal lattice form, which is the form in which unalloyed zirconium and titanium normally exist at room temperature.

Zirconium and titanium can be stabilized to remain in the body-centered cubic crystal lattice form throughout the temperature range from room temperature (about 20° C) up through ion pump operating temperatures (in the 50° to 300° C range) and pump bakeout temperatures (typically in the 450° to 550° C range) by being alloyed with elements selected from Groups III B (including the elements of the lanthanum series), V B, VI B and VII B of the conventional long form of the Periodic Chart of the Elements as published, for example, beginning on page 448 in the Handbook of Chemistry and Physics, 42nd Edition (1960–1961), by the Chemical Rubber Publishing Co. The stabilizing elements include vanadium, niobium, tantalum, chromium, molybdenum, tungsten, manganese, scandium, yttrium, and the elements of the lanthanum series. A useful reference work in this subject is the article entitled "The Theoretical Bases of the Development of the High-Strength Metastable Beta-Alloys of Titanium" by N. V. Ageev and L. A. Petrova, appearing in The Science, Technology and Application of Titanium, Pergamon Press, 1966 at pages 809 and 814. The formation of titanium alloys stabilized in the body-centered cubic crystal lattice form is discussed in detail in that reference work. It has been observed that the formation of body-centered cubic crystal lattice structured zirconium alloys can be achieved by metallurgical techniques similar to those disclosed in the above work dealing with titanium. Similarly, it is to be anticipated that body-centered cubic crystal lattice structured hafnium alloys can be achieved by similar metallurgical techniques.

A commercially available alloy of titanium, designated as Ti-13V-11Cr-3Al, has been found to be especially suitable for being fabricated into sputter-ion pump components. This alloy is available from Titanium Metals Corporation of America, New York, and was developed for structural applications in missile and advanced manned airborne systems. It is believed that there has not been any published indication of the special advantage of this alloy for vacuum systems applications in which the hydrogen diffusion rate is a more important parameter than high strength, light weight or corrosion resistance. The numerical coefficients of the designated alloy indicate that the alloy contains, by weight, 13% vanadium, 11% chromium, 3% aluminum, and the balance (i.e., 73%) titanium. The 3% aluminum actually serves to suppress rather than to aid in the stabilization of the alloy in the body-centered cubic crystal lattice form. Aluminum is therefore undesirable with respect to the hydrogen pumping properties of the alloy. However, aluminum is added to improve the metalworking characteristics of the alloy, and is considered to be necessary for this purpose. It has been found that alloying elements selected from Group III A (such a aluminum) or from other Groups which serve to suppress the stabilization of the alloy in the body-centered cubic crystal lattice form can nevertheless be tolerated for vacuum pump applications, provided that the total proportion of such elements in the alloy does not exceed 5% by weight. The rate of diffusion of hydrogen into vacuum pump components made of the Ti-13V-11Cr-3Al alloy is significantly greater than the rate of diffusion of hydrogen into zirconium or titanium components having the hexagonal close-packed crystal lattice form. It therefore appears that the 3% aluminum does not diminish the suitability of Ti-13V-11Cr-3Al for hydrogen pump components. Another commercially available alloy suitable for the fabrication of hydrogen pump components, according to the criteria of this invention, is an alloy designated by the formula Ti-11.5Mo-6Zr-4.5Sn, indicating that the alloy consists of the following proportions by weight: 11.5% molybdenum, 6% zirconium, 4.5% tin and 78% titanium. This alloy is available from Colt Industries, Crucible Steel Specialty Metals Division of Syracuse, New York, and was developed for the manufacture of rivets. It is likewise believed that there has not been any published indication of the suitability of this alloy for vacuum pump applications.

The enhanced rate of hydrogen diffusion obtainable with a body-centered cubic crystal lattice indicates that it would be desirable from a pumping standpoint to fabricate as many components as possible of a vacuum pump that are in contact with the vacuum from an alloy that has been stabilized in the body-centered cubic crystal lattice form. Thus, in a sputter-ion pump as shown in the drawing, it would be desirable to make not only the cathode plates 21 but also the walls of envelope 12 and/or the anode 14 out of gettering material stabilized in the body-centered cubic crystal lattice form. Where the vacuum envelope walls are made of an alloy as provided by this invention, the walls can themselves form the cathode of the sputter-ion pump because the need for mounting special cathode material upon a structural component, e.g., stainless steel which is not intended as sputter material, would thereby be eliminated.

Although it is envisioned that vacuum pump components will provide the primary applications for alloys according to this invention, it is also anticipated that such alloys would find application in any vacuum system where hydrogen presence in the vacuum region is to be minimized.

At the present time, in view of the limited number of alloys of titanium and zirconium that are commerically available for the fabrication of vacuum pump components on a mass-production basis, the Ti-13V-11Cr-3Al alloy and the Ti-11.5Mo-6Zr-4.5SN alloy constitute the preferred embodiments of this invention. Inasmuch as other alloys that maintain a body-centered cubic crystal lattice structure throughout the temperature range normally experienced by a high-vacuum pump are comprehended within the scope of this invention, the invention is limited only by the following claims.

What is claimed is:

1. In a sputter-ion vacuum pump comprising an evacuable chamber including cathode and anode members each positioned within said chamber, means for maintaining a magnetic field within the region between said cathode and anode members, lead means for introducing an electrical potential difference between said cathode and anode members, whereby a plasma can be formed to cause gas ions to bombard said cathode member; the improvement comprising said cathode member being made from an alloy, said alloy comprising a major constituent selected from elements in Group IV B of the conventional long form of the Periodic Chart of the Elements and a minor constituent selected from elements in other than Group IV B of said Periodic Chart, which minor constituent is an amount that causes the transition temperature for the transformation from the hexagonal close-packed crystal lattice form to the body-centered cubic crystal lattice form for said alloy to be lowered from the corresponding transition temperature for said major constituent alone.

2. In the sputter-ion vacuum pump of claim 1 wherein said minor constituent is selected from elements in Groups III B, V B, VI B and VII B of said Periodic Chart.

3. In the sputter-ion vacuum pump of claim 1 wherein said minor constituent constitutes at least 10% but not more than 50% by weight of said alloy.

4. In the sputter-ion vacuum pump of claim 1 wherein said alloy is stabilized in the body-centered/cubic crystal lattice form throughout the temperature range from 550°down to 20° C.

5. In the sputter-ion vacuum pump of claim 1 wherein said major constituent comprises zirconium.

6. In the sputter-ion vacuum pump of claim 1 wherein said major constituent comprises titanium.

7. In the sputter-ion vacuum pump of claim 1 wherein said additional constituent comprises aluminum.

8. The sputter-ion vacuum pump of claim 1 wherein said major constituent comprises hafnium.

9. In the sputter-ion vacuum pump of claim 1 wherein said alloy further comprises an additional constituent selected from elements in Group III A of said Periodic Chart.

10. In the sputter-ion vacuum pump of claim 9 wherein said additional constituent constitutes less than 5% by weight of said alloy.

11. In the sputter-ion vacuum pump of claim 9 wherein said alloy comprises 73% titanium, 13% vanadium, 11% chromium and 3% aluminum by weight.

12. In the sputter-ion vacuum pump of claim 9 wherein said alloy comprises 78% titanium, 11.5% molybdenum, 6% zirconium and 4.5% tin by weight.

* * * * *